US007343636B1

(12) United States Patent
Castillo

(10) Patent No.: US 7,343,636 B1
(45) Date of Patent: Mar. 18, 2008

(54) COMBINATION CHEERING AID AND SEAT CUSHION

(76) Inventor: John M. Castillo, 1424 106th Ave. NW., Coon Rapids, MN (US) 55433

( * ) Notice: Subject to any disclaimer, the term of this patent is extended or adjusted under 35 U.S.C. 154(b) by 537 days.

(21) Appl. No.: 11/073,211

(22) Filed: Mar. 5, 2005

(51) Int. Cl.
*A47C 7/16* (2006.01)

(52) U.S. Cl. ..... 5/653; 5/655.9; 5/657; 5/904; 5/907

(58) Field of Classification Search ..... 5/653, 5/655.9, 656, 657, 904, 907
See application file for complete search history.

(56) References Cited

U.S. PATENT DOCUMENTS 4,037,340 A * 7/1977 Owensmith ..... 40/586
4,369,215 A * 1/1983 Offen et al. ..... 428/4
4,441,271 A * 4/1984 Hutchinson ..... 40/584
4,637,151 A * 1/1987 Love et al. ..... 40/584
4,925,241 A * 5/1990 Geraci ..... 297/229
5,368,518 A 11/1994 Hitchcock
5,572,758 A * 11/1996 Merritt ..... 5/653
D386,224 S * 11/1997 Seagren et al. ..... D21/400
6,009,653 A 1/2000 Harrington
D422,319 S 4/2000 Pool et al.
6,108,817 A 8/2000 Kostelac
6,691,356 B1 * 2/2004 Coma ..... 5/722
2005/0125878 A1 * 6/2005 Bjelland ..... 2/207

* cited by examiner

*Primary Examiner*—Michael Trettel

(57) ABSTRACT

A combination cheering aid and a seat cushion has a first elongate polygonal clapper. The first polygonal clapper has two ends, a lower end, and an upper end. The lower end has a hand hold cavity therein for insertion of user fingers. An anchor is connected to the first polygonal clapper, the anchor has two ends, an insertion end and an attachment end. The anchor insertion end has two flexible tines which are directed toward the anchor attachment end. The anchor attachment end has an eyelet formed therein for attachment of accessories to the anchor.

20 Claims, 3 Drawing Sheets

COMBINATION CHEERING AID AND SEAT CUSHION

BACKGROUND OF THE INVENTION

1. Field of the Invention

The present embodiment of the invention relates to a combination cheering aid and a seat cushion for use in connection with portable seat cushions. The combination cheering aid and a seat cushion has particular utility in connection with portable seat cushion which can be separated into two sections to be used as a clapping device.

2. Description of the Prior Art

Combination seat cushion and cheering aids are desirable for showing support for an organization or team. A need has been felt for a cheering aid that could amplify clapping and that could additionally be used as a seat cushion during times between cheering. Additionally, a need was felt for a cheering aid that would have an anchor to which the user could attach an accessory of his choice such as a pom pom, streamer or flag.

The use of portable seat cushions is known in the prior art. For example, U.S. Pat. No. 4,441,271 to Hutchinson discloses a combination portable seat cushion and pennant comprising a foldable carrying case having two pockets therein in side-by-side relationship foldable along their common border, each pocket having an open end to receive therein respectively a pair of cushions. Each of the cushions comprises a block of foam rubber or plastic or other cushioning material enclosed within an outer covering of flexible sheet material such as plastic, cloth, leather or the like. The cushions are readily removable from their respective pockets of the carrying case for use as pennants and noisemakers during the course of a sporting event. Each cushion includes a broad, substantially flat surface which the spectator can slap together when holding one of the cushions in each hand to use as a noisemaker during the sporting event. Such surfaces also include descriptive material thereon for use as pennants such as team colors, words comprising team cheers and the like which the spectator can display during the game. When the cushions are reinserted into their respective pockets of the carrying case, the carrying case is then folded over with one cushion on top of the other for use as a seat cushion. However, the Hutchinson '271 patent does not provide two elongate polygonal clapping rods having hand holds and an elastic band to hold the clapping rods together for use as a seat cushion.

Similarly, U.S. Pat. No. 6,108,817 to Kostelac discloses a Hand-shaped novelty hand sign foam rubber body portion having a front panel and a rear panel. The invention has a vinyl plastic or other like material covering which is affixed continuously to said front panel. The rear panel contains five digit slits in a pattern such that the spectator can press his or her fingers into the slits to wear the novelty hand. The invention has an orifice in one of the corners of the bottom of said foam rubber body and a hand strap which is connected to the body through the orifice. The covering can be affixed with team logos, colors, slogans or the like such that the spectator can visually communicate his or her support. However, the Kostelac '817 patent does not provide two elongate polygonal clapping rods having hand holds and an elastic band to hold the clapping rods together for use as a seat cushion.

Likewise, U.S. Pat. No. 5,572,758 to Merritt discloses a combination seat cushion for use for example at sporting events or contests. A hand hole is provided which makes the cushion convenient to carry to and from a sporting or other event. In order to demonstrate enthusiasm for a particular contestant or team, the item is held overhead for use as a portable, handheld display sign or billboard. An imprint might be used for showing support for a particular race car and driver. The faces of the cushion may be imprinted with insignia of a team such as a university or professional football team. An imprint might be used to show support for a ball team. An alternate embodiment has a hand hole adapted to receive a beverage cup. An alternate embodiment is useful for display of a long word or a series of words wherein the long dimensions of the cushion and display are horizontal. Another alternate embodiment is elongated for use by two or more users. However, the Merritt '758 patent does not provide two elongate polygonal clapping rods having hand holds and an elastic band to hold the clapping rods together for use as a seat cushion.

Correspondingly, U.S. Pat. No. Des. 422,319 to Pool et al. discloses a sports fan novelty item that is shaped like the number one. However, the Pool et al. '319 patent does not provide two elongate polygonal clapping rods having hand holds and an elastic band to hold the clapping rods together for use as a seat cushion.

Further, U.S. Pat. No. 6,009,653 to Harrington discloses a graphic material display device having a baseball bat-like shape. A centrally located shoulder and a second shoulder located adjacent one of the ends are connected by a web portion and support a transparent, hollow, cylindrical tube. Graphic material placed adjacent the web portion and within in the tube may be viewed through the tube. A sleeve selectively locks the tube in position or permits the tube to be removed to change the graphic material. However, the Harrington '653 patent does not provide two elongate polygonal clapping rods having hand holds and an elastic band to hold the clapping rods together for use as a seat cushion.

Further yet, U.S. Pat. No. Des. 386,224 to Seagren et al. discloses a fan cheering accessory that is two elongate circular inflatable bags. However, the Seagren et al. '224 patent does not provide two elongate polygonal clapping rods having hand holds and an elastic band to hold the clapping rods together for use as a seat cushion.

Lastly, U.S. Pat. No. 5,368,518 to Hitchcock discloses a puppet head that is manipulated by both arms of a user primarily as a form of cheering for a person or entity during sporting and similar events. The puppet comprises a first member including a first elongated sleeve into which a first arm of the user may be inserted. A second member is secured to the first member and includes a second elongated sleeve into which a second arm of the user may be inserted. The first and second members cooperate to provide a puppet in the shape of a mascot or character identified with the person or entity being cheered. The first and second members are secured together in a manner which permits the user to impart relative motion through arm movements. However, the Hitchcock '518 patent does not provide two elongate polygonal clapping rods having hand holds and an elastic band to hold the clapping rods together for use as a seat cushion.

While the above-described devices fulfill their respective, particular objectives and requirements, the aforementioned patents do not describe a combination cheering aid and a seat cushion that allows portable seat cushion which can be separated into two sections to be used as a clapping device. The Hutchinson '271, Kostelac '817, Merritt '758, Pool et al. '319, Harrington '653, Seagren et al. '224 and Hitchcock '518 patents make no provision for two elongate polygonal clapping rods having hand holds and an elastic band to hold the clapping rods together for use as a seat cushion.

Therefore, a need exists for a new and improved combination cheering aid and a seat cushion which can be used for portable seat cushion which can be separated into two sections to be used as a clapping device. In this regard, the present embodiment of the invention substantially fulfills this need. In this respect, the combination cheering aid and a seat cushion according to the present embodiment of the invention substantially departs from the conventional concepts and designs of the prior art, and in doing so provides an apparatus primarily developed for the purpose of portable seat cushion which can be separated into two sections to be used as a clapping device.

SUMMARY OF THE INVENTION

In view of the foregoing disadvantages inherent in the known types of portable seat cushions now present in the prior art, the present embodiment of the invention provides an improved combination seat cushion and cheering aid, and overcomes the above-mentioned disadvantages and drawbacks of the prior art. As such, the general purpose of the present embodiment of the invention, which will be described subsequently in greater detail, is to provide a new and improved combination cheering aid and a seat cushion and method which has all the advantages of the prior art mentioned heretofore and many novel features that result in a combination cheering aid and a seat cushion which is not anticipated, rendered obvious, suggested, or even implied by the prior art, either alone or in any combination thereof.

To attain this, the present embodiment of the invention essentially has a first elongate polygonal clapper. The first polygonal clapper has two ends, a lower end, and an upper end. The lower end has a hand hold cavity therein for insertion of user fingers. An anchor is connected to the first polygonal clapper, the anchor has two ends, an insertion end and an attachment end. The anchor insertion end has two flexible tines which are directed toward the anchor attachment end. The anchor attachment end has an eyelet formed therein for attachment of accessories to the anchor.

There has thus been outlined, rather broadly, the more important features of the embodiment of the invention in order that the detailed description thereof that follows may be better understood and in order that the present contribution to the art may be better appreciated.

The present embodiment of the invention may also include a second elongate polygonal clapper, a flexible band, a carrying strap, a pom pom, a streamer, a flag and a handle There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved combination cheering aid and a seat cushion that has all of the advantages of the prior art portable seat cushions and none of the disadvantages.

It is another object of the present embodiment of the invention to provide a new and improved combination cheering aid and a seat cushion that may be easily and efficiently manufactured and marketed.

An even further object of the present embodiment of the invention is to provide a new and improved combination cheering aid and a seat cushion that has a low cost of manufacture with regard to both materials and labor, and which accordingly is then susceptible of low prices of sale to the consuming public, thereby making such combination cheering aid and a seat cushion economically available to the buying public.

Still another object of the present embodiment of the invention is to provide a new combination cheering aid and a seat cushion that provides in the apparatuses and methods of the prior art some of the advantages thereof, while simultaneously overcoming some of the disadvantages normally associated therewith.

Even still another object of the present embodiment of the invention is to provide a combination cheering aid and a seat cushion having an anchor for attaching a user defined accessory.

Lastly, it is an object of the present embodiment of the invention is to provide a combination cheering aid and a seat cushion for portable seat cushion which can be separated into two sections to be used as a clapping device.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
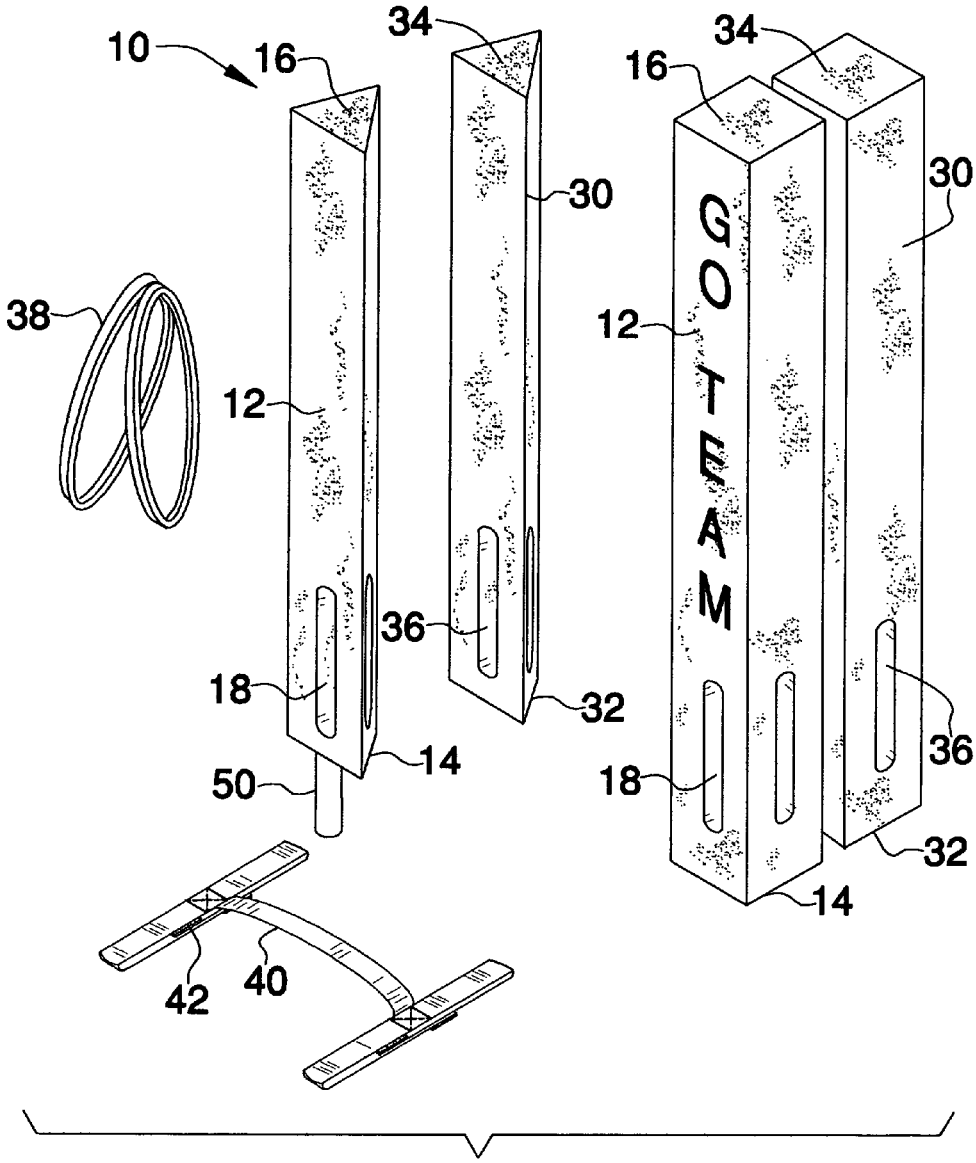
FIG. 1 is a top perspective view of the preferred embodiment of the combination cheering aid and a seat cushion constructed in accordance with the principles of the present invention.

Referring now to the drawings, and particularly to FIGS. 1-4, a preferred embodiment of the combination cheering aid and a seat cushion of the present invention is shown and generally designated by the reference numeral 10.

In FIG. 1, a new and improved combination cheering aid and a seat cushion 10 of the present invention is for portable seat cushion which can be separated into two sections to be used as the clapping device is illustrated and will be described. More particularly, the combination cheering aid and a seat cushion 10 has a first elongate polygonal clapper 12. The first polygonal clapper 12 has two ends, a lower end 14, and an upper end 16. The first polygonal clapper lower end 14 has a hand hold cavity 18 therein is for insertion of user finger. The first polygonal clapper 12 is comprised of foam rubber. The first polygonal clapper 12 is approximately 3 inches wide. The first polygonal clapper is approximately 3 inches deep. The first polygonal clapper is approximately 16 to 20 inches long. A second elongate polygonal clapper 30 has two ends, a lower end 32, and an upper end 34. The second polygonal clapper lower end 32 has a hand hold cavity 36 therein for insertion of user fingers. A flexible band 38 is for frictionally connecting the first polygonal clapper 12 to the second polygonal clapper 30 so that the clappers can be used as the seat cushion. A carrying strap 40 is detachably connected to the first polygonal clapper 12. The carrying strap 40 has a loop and hook fastener 42. A handle 50 is connected to the first polygonal clapper 12. The handle 50 may be rigid or formed of the same material as the rest of the clapper 12. In the preferred embodiment, the clapper is made of polyethylene foam of a density ranging from 1.8-2.0. This density allows for a loud noise when the first clapper 12 is hit against the second clapper 30. Alternatively, another foam or foam rubber material could be employed; however, the noise emitted from hitting the clappers will not be as loud.

Figure 2:
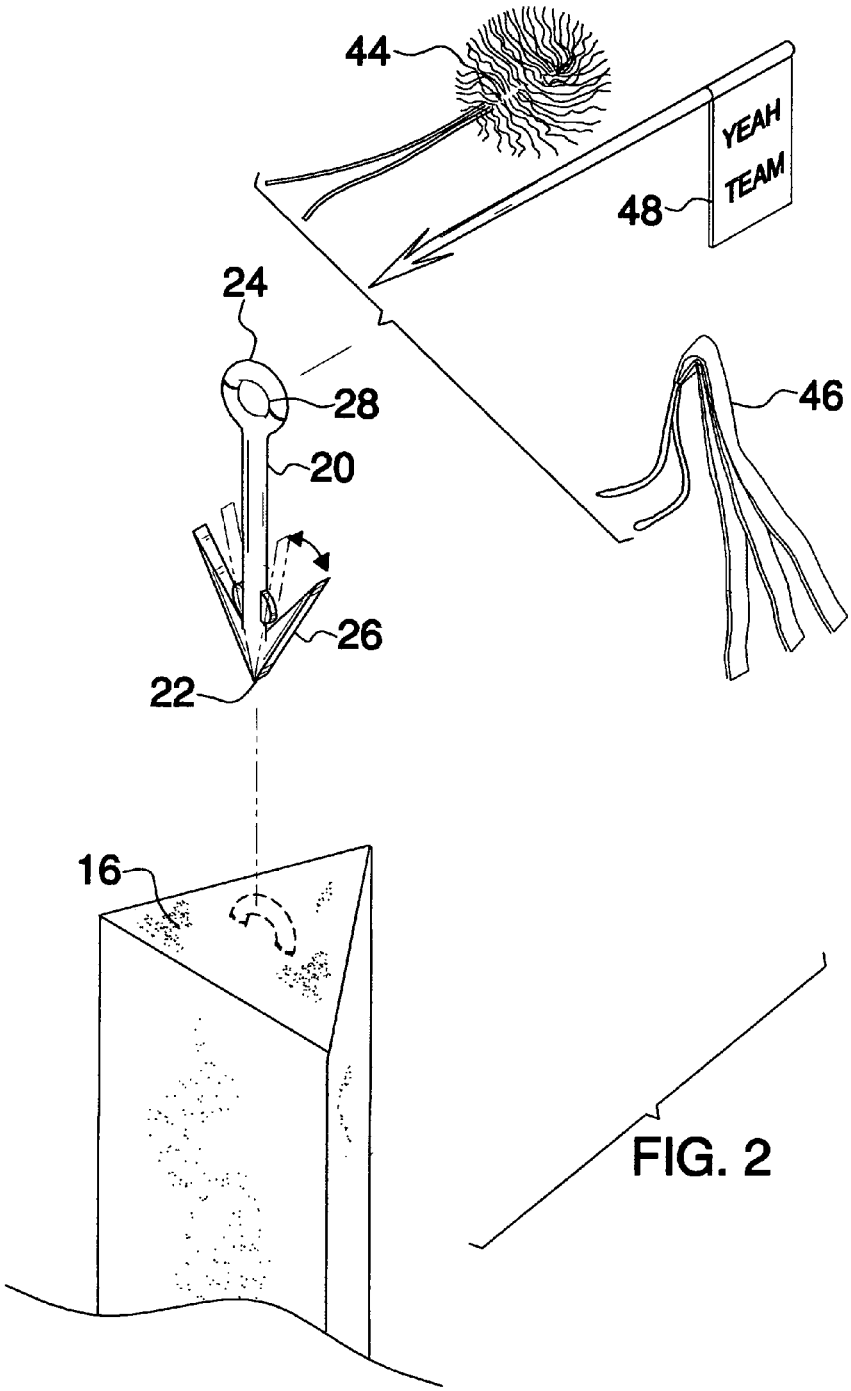
FIG. 2 is a top perspective view of the combination cheering aid and a seat cushion of the present embodiment of the invention.

In FIG. 2, the combination cheering aid and a seat cushion 10 is illustrated and will be described. More particularly, the combination cheering aid and a seat cushion 10 has the first polygonal clapper upper end 16. An anchor 20 is connected to the first polygonal clapper 12, the anchor 20 has two ends, an insertion end 22 and an attachment end 24. The anchor insertion end 22 has a set of flexible tine 26 which are directed toward the anchor attachment end 24. The anchor attachment end 24 has an eyelet 28 that is formed therein is for attachment of accessories to the anchor 20. A pom pom 44 is attached to the anchor eyelet 28, in alternate embodiments, a streamer 46 is attached to the anchor eyelet 28 and a flag 48 is attached to the anchor 20.

Figure 3:
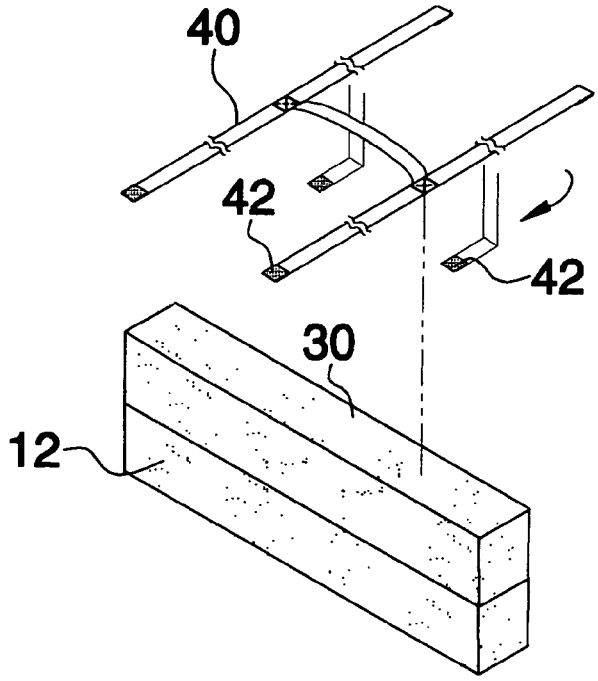
FIG. 3 is a top perspective view of the combination cheering aid and a seat cushion of the present embodiment of the invention.

In FIG. 3, the combination cheering aid and a seat cushion 10 is illustrated and will be described. More particularly, the combination cheering aid and a seat cushion 10 has the first elongate polygonal clapper 12 and the second polygonal clapper 30. The carrying strap 40 is detachably connected to the first polygonal clapper 12 and the second polygonal clapper 30.

Figure 4:
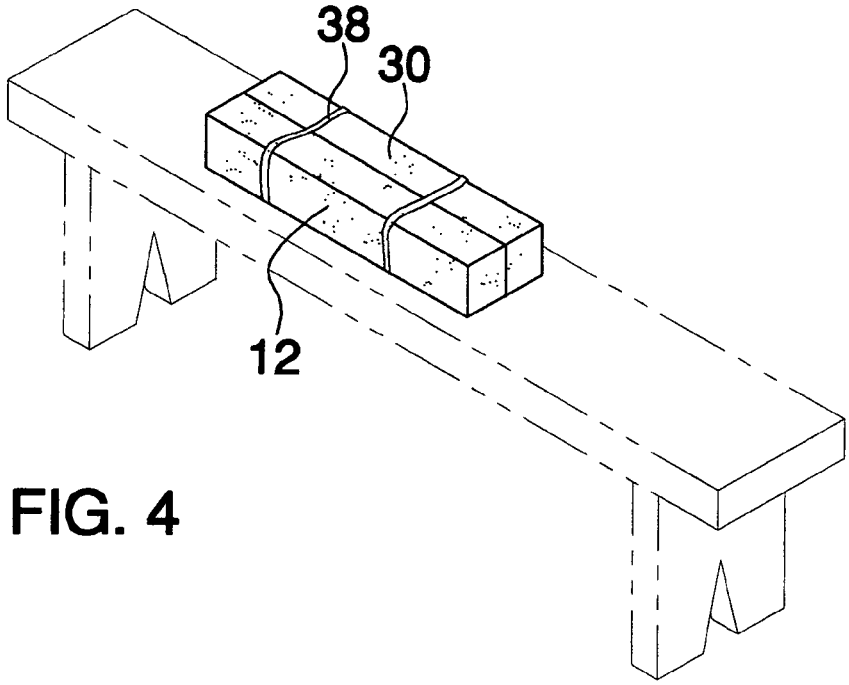
FIG. 4 is a top perspective view of the combination cheering aid and a seat cushion of the present embodiment of the invention.

In FIG. 4, the combination cheering aid and a seat cushion 10 is illustrated and will be described. More particularly, the combination cheering aid and a seat cushion 10 has the first elongate polygonal clapper 12 and the second polygonal clapper 30. The flexible band 38 is for frictionally connecting the first polygonal clapper 12 to the second polygonal clapper 30 so that the clappers can be used as the seat cushion. The flexible band 38 also functions as a carry strap.

While a preferred embodiment of the combination cheering aid and a seat cushion has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. Additionally, slogans, advertisements or team logos may be imprinted on the invention.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

I claim:

1. A combination cheering aid and a seat cushion comprising:

a first elongate polygonal clapper, said first polygonal clapper having two ends, a lower end, and an upper end, said lower end having a hand hold cavity therein for insertion of user fingers; and an anchor connected to said first polygonal clapper, said anchor having two ends, an insertion end and an attachment end, said anchor insertion end having two flexible tines which are directed toward the anchor attachment end, said anchor attachment end having an eyelet formed therein for attachment of accessories to the anchor.

2. The combination cheering aid and a seat cushion of claim 1 further comprising:

a second elongate polygonal clapper, said second polygonal clapper having two ends, a lower end, and an upper end, said lower end having a hand hold cavity therein for insertion of user fingers; and a flexible band for frictionally connecting said first polygonal clapper to said second polygonal clapper for use as a seat cushion.

3. The combination cheering aid and a seat cushion of claim 1 wherein:

said first polygonal clapper is comprised of foam rubber.

4. The combination cheering aid and a seat cushion of claim 1 wherein:

said first polygonal clapper is approximately 3 inches wide, said first polygonal clapper is approximately 3 inches deep.

5. The combination cheering aid and a seat cushion of claim 1 further comprising:

said first polygonal clapper is approximately 16 to 20 inches long.

6. The combination cheering aid and a seat cushion of claim 1 further comprising:

a carrying strap detachably connectable to said first polygonal clapper, said carrying strap having a loop and hook fastener.

7. The combination cheering aid and a seat cushion of claim 1 further comprising:

a handle connected to said first polygonal clapper.

8. The combination cheering aid and a seat cushion of claim 1 further comprising:

a pom pom attachable to said anchor eyelet.

9. The combination cheering aid and a seat cushion of claim 1 further comprising:

a streamer attachable to said anchor eyelet.

10. The combination cheering aid and a seat cushion of claim 1 further comprising:

a flag attachable to said anchor.

11. A combination cheering aid and a seat cushion comprising:

a first elongate polygonal clapper, said first polygonal clapper having two ends, a lower end, and an upper end, said lower end having a hand hold cavity therein for insertion of user fingers;

an anchor connected to said first polygonal clapper, said anchor having two ends, an insertion end and an attachment end, said anchor insertion end having two flexible tines which are directed toward the anchor attachment end, said anchor attachment end having an eyelet formed therein for attachment of accessories to the anchor;

a second elongate polygonal clapper, said second polygonal clapper having two ends, a lower end, and an upper end, said lower end having a hand hold cavity therein for insertion of user fingers; and a flexible band for frictionally connecting said first polygonal clapper to said second polygonal clapper for use as a seat cushion.

12. The combination cheering aid and a seat cushion of claim 11 wherein:

said first polygonal clapper is comprised of foam rubber.

13. The combination cheering aid and a seat cushion of claim 12 wherein:

said first polygonal clapper is approximately 3 inches wide, said first polygonal clapper is approximately 3 inches deep.

14. The combination cheering aid and a seat cushion of claim 13 further comprising:

said first polygonal clapper is approximately 16 to 20 inches long.

15. The combination cheering aid and a seat cushion of claim 14 further comprising:

a carrying strap detachably connectable to said first polygonal clapper, said carrying strap having a loop and hook fastener.

16. The combination cheering aid and a seat cushion of claim 14 further comprising:

a handle connected to said first polygonal clapper.

17. The combination cheering aid and a seat cushion of claim 15 further comprising:

a pom pom attachable to said anchor eyelet.

18. The combination cheering aid and a seat cushion of claim 15 further comprising:

a streamer attachable to said anchor eyelet.

19. The combination cheering aid and a seat cushion of claim 15 further comprising:

a flag attachable to said anchor.

20. A combination cheering aid and a seat cushion comprising:

a first elongate polygonal clapper, said first polygonal clapper having two ends, a lower end, and an upper end, said lower end having a hand hold cavity therein for insertion of user finger, said first polygonal clapper is comprised of foam rubber, said first polygonal clapper is approximately 3 inches wide, said first polygonal clapper is approximately 3 inches deep, said first polygonal clapper is approximately 16 to 20 inches long;

an anchor connected to said first polygonal clapper, said anchor having two ends, an insertion end and an attachment end, said anchor insertion end having two flexible tines which are directed toward the anchor attachment end, said anchor attachment end having an eyelet formed therein for attachment of accessories to the anchor;

a second elongate polygonal clapper, said second polygonal clapper having two ends, a lower end, and an upper end, said lower end having a hand hold cavity therein for insertion of user fingers;

a flexible band for frictionally connecting said first polygonal clapper to said second polygonal clapper for use as a seat cushion;

a carrying strap detachably connectable to said first polygonal clapper, said carrying strap having a loop and hook fastener; and a pom pom attachable to said anchor eyelet.

* * * * *